US010119533B2

(12) United States Patent
Beenker

(10) Patent No.: US 10,119,533 B2
(45) Date of Patent: Nov. 6, 2018

(54) DELIVERY DEVICE

(71) Applicant: Qonqave GmbH, Wernau (DE)

(72) Inventor: Jan W. Beenker, Stuttgart (DE)

(73) Assignee: QONQAVE GMBH, Wernau (DE)

( * ) Notice: Subject to any disclaimer, the term of this patent is extended or adjusted under 35 U.S.C. 154(b) by 0 days.

(21) Appl. No.: 15/536,977

(22) PCT Filed: Dec. 17, 2015

(86) PCT No.: PCT/EP2015/080238
§ 371 (c)(1),
(2) Date: Jun. 16, 2017

(87) PCT Pub. No.: WO2016/097154
PCT Pub. Date: Jun. 23, 2016

(65) Prior Publication Data

US 2018/0003166 A1 Jan. 4, 2018

(30) Foreign Application Priority Data

Dec. 17, 2014 (DE) ..... 10 2014 118 925

(51) Int. Cl.
*F04B 43/02* (2006.01)
*F04B 43/073* (2006.01)
(Continued)

(52) U.S. Cl.
CPC ..... *F04B 43/0736* (2013.01); *F04B 43/02* (2013.01); *F04B 43/04* (2013.01);
(Continued)

(58) Field of Classification Search
CPC .... F04B 43/02; F04B 43/021; F04B 43/1238; F04B 43/14; F04B 43/0736; F04B 43/04;
(Continued)

(56) References Cited

U.S. PATENT DOCUMENTS 2,755,893 A 7/1956 Male
4,236,880 A 12/1980 Archibald
(Continued)

FOREIGN PATENT DOCUMENTS

CA 2422579 C 11/2008
DE 2611672 A1 * 9/1977 ..... F04C 2/1071
(Continued)

OTHER PUBLICATIONS

Search Report dated Oct. 15, 2015 issued in corresponding DE patent application No. 10 2014 118 925.6 (and partial English translation).
(Continued)

*Primary Examiner* — Nathan C Zollinger
(74) *Attorney, Agent, or Firm* — Posz Law Group, PLC

(57) ABSTRACT

A conveying device at least for conveying a fluid, includes at least one conveying space, with at least one conveying space element, which at least partly delimits the conveying space and is embodied in a rigid fashion, and with at least one elastically deformable conveying element, which forms the conveying space together with the conveying space element, at least the conveying space element and the conveying element together form an exchangeable unit. The conveying element is arranged on the conveying space element in an at least partly convexly curved fashion, following a deformation, the conveying element automatically seeks to re-assume a basic shape, and the conveying element is connected to the conveying space element in a non-releasable manner.

9 Claims, 6 Drawing Sheets

Figure 1:
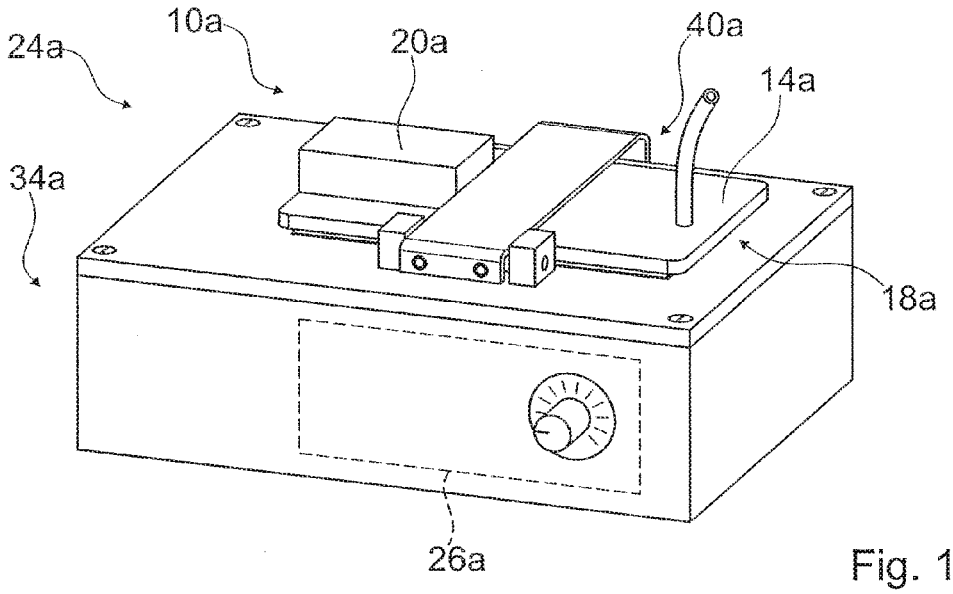

(51) Int. Cl.

| | |
|---|---|
| ***F04B 43/04*** | (2006.01) |
| ***F04B 43/08*** | (2006.01) |
| ***F04B 43/14*** | (2006.01) |
| ***F04C 5/00*** | (2006.01) |
| *F04B 9/04* | (2006.01) |
| *F04B 43/00* | (2006.01) |

(52) U.S. Cl.
CPC ..... *F04B 43/08* (2013.01); *F04B 43/14* (2013.01); *F04C 5/00* (2013.01); *F04B 9/042* (2013.01); *F04B 43/0072* (2013.01); *F04B 43/082* (2013.01)

(58) Field of Classification Search
CPC .... F04B 43/0072; F04B 43/082; F04B 9/042; F04B 43/08; F04C 5/00
See application file for complete search history.

(56) References Cited

U.S. PATENT DOCUMENTS 5,563,347 A 10/1996 Martin et al.
6,293,926 B1 * 9/2001 Sorensen ..... A61M 1/0058 417/477.2
6,890,161 B2 * 5/2005 Paukovits, Jr. ..... F04B 23/026 222/325
8,844,771 B2 * 9/2014 Centofante ..... F04B 43/12 222/167
2012/0177506 A1 7/2012 Örter
2013/0331774 A1 * 12/2013 Farrell ..... A61M 1/28 604/28

FOREIGN PATENT DOCUMENTS

DE 102009037845 A1 4/2011
EP 1317626 B1 8/2006
FR 2523656 A1 9/1983

OTHER PUBLICATIONS

International Search Report of the International Searching Authority dated Mar. 29, 2016 issued in corresponding International Patent Application No. PCT/EP2015/080238.
International Preliminary Report on Patentability dated Jun. 22, 2017 issued in corresponding International Patent Application No. PCT/EP2015/080238 (and German version of Nov. 30, 2016 with Article 34 amendments).

* cited by examiner

DELIVERY DEVICE

CROSS REFERENCE TO RELATED APPLICATIONS

This application is a U.S. national stage application of PCT/EP2015/080238 filed on Dec. 17, 2015, which claims priority to German Patent Application No. DE 10 2014 118 925.6 filed on Dec. 17, 2014, the contents of which are incorporated herein by reference.

PRIOR ART

The invention relates to a conveying device as per the preamble of claim 1.

EP 1 317 626 B1, U.S. Pat. No. 4,236,880 A, U.S. Pat. No. 5,563,347 A, and FR 2 523 656 A1 have already proposed conveying devices for conveying a fluid which comprise a conveying space, a conveying space element which at least partly delimits the conveying space and is embodied in rigid fashion, and an elastically deformable conveying element, which forms the conveying space together with the conveying space element.

Furthermore, from DE 10 2009 037 845 A1 a conveying device at least for conveying a fluid is already known, with at least one conveying space, with at least one conveying space element, which at least partly delimits the conveying space and is embodied in a rigid fashion, and with at least one elastically deformable conveying element, which forms the conveying space together with the conveying space element, wherein at least the conveying space element and the conveying element together form an exchangeable unit, wherein the conveying element is arrangeable at least partly on the conveying space element in an at least partly convexly curved fashion, wherein the conveying element is embodied in a spring-elastic fashion, wherein, following a deformation, the conveying element automatically seeks to re-assume a basic shape, in particular a convexly curved basic shape of the conveying element, wherein the conveying element is connected to the conveying space element in an at least substantially non-releasable manner.

It is the object of the invention in particular to provide a generic device with improved characteristics with regard to a small load on the conveying element due to a deformation, for the purpose of reducing a compression, respectively expansion, of the conveying element during a conveyance of a fluid. The object is achieved according to the invention by means of the features of patent claim 1, whereas advantageous embodiments and refinements of the invention emerge from the subclaims.

ADVANTAGES OF THE INVENTION

The invention is based on a conveying device at least for conveying a fluid, with at least one conveying space, with at least one conveying space element, which at least partly delimits the conveying space and is embodied in a rigid fashion, and with at least one elastically deformable conveying element, which forms the conveying space together with the conveying space element, wherein at least the conveying space element and the conveying element together form an exchangeable unit, wherein the conveying element arrangeable on the conveying space element in an at least partly convexly curved fashion, wherein the conveying element is embodied in a spring-elastic fashion, and wherein the conveying element is connected to the conveying space element in an at least substantially non-releasable manner.

It is proposed that the conveying space element comprises at least one concave recess for at least partly forming the conveying space, wherein an inner surface of the conveying space element, which delimits the concave recess, forms a wall of the conveying space, wherein the conveying element comprises, in a load-free state of the conveying element, a conveying surface which, viewed in a cross-section of the conveying element, has a maximum transverse extent that is equivalent to a maximum transverse extent of the rigid wall of the conveying space element, which wall at least partly delimits at least the conveying space, wherein the conveying surface is utilizable in a targeted fashion for a conveyance of a fluid in the conveying space and/or through the conveying space. Here, an "exchangeable unit" is to be understood in particular to mean a unit which is removable as a whole, in particular without being destroyed or without disassembly of individual parts, from an element or from a further unit, such as for example from a housing unit or the like, in particular after a release of at least one fastening element which is provided for fastening and/or aligning the unit on the element or on the further unit. In particular, the exchangeable unit is at least substantially free from function, and/or non-functional, when in a removed state, in particular in a state removed from the housing unit. The conveying device is preferably provided for being arranged on a pump device. The expression "provided" is to be understood in particular to mean specially designed and/or specially equipped. The statement that an element and/or a unit are/is provided for a particular function is to be understood in particular to mean that the element and/or the unit perform(s) and/or carry/carries out said particular function in at least one usage and/or operating state. The exchangeable unit is preferably removable as a whole from the element or from the further unit without being disassembled into individual parts. It is thus preferably the case that at least the conveying space element and the conveying element are jointly removable from the element or from the further unit, in particular from a housing unit of a pump device which at least partly, in particular entirely, comprises the conveying device. It is preferable if the exchangeable unit is, after being removed from the element or from the further unit, exchangeable for a replacement or substitute unit which, with regard to at least one function of the replacement or substitute unit, at least substantially corresponds to at least one function of the exchangeable unit. The exchangeable unit is preferably designed such that, in the event of an exchange of the exchangeable unit, a loss of fluid and/or an escape of fluid from the conveying device and/or from the pump device are/is at least substantially preventable. The exchangeable unit is preferably formed as a disposable article unit. It is however also conceivable for the exchangeable unit to be in the form of an interchangeable unit, a wearing part unit, a substitute unit or the like. The conveying device is preferably provided for use in the medical sector. It is however also conceivable for the conveying device to be provided for use in other sectors in which easy exchangeability at least of the conveying space element and of the conveying element, which at least together form the exchangeable unit, is expedient or necessary, for example in a foodstuffs sector, in a chemistry sector, in a pharmaceutical sector, in particular for batch-compliant use, in a vivarium sector (aquarium etc.), in a household appliance sector, in a dental hygiene sector or the like.

Here, the expression "embodied in a rigid fashion" is intended in particular to define an embodiment of an element in which the element is of at least substantially stiff, immovable and/or inelastic form. The conveying space element preferably has at least one concave recess for at least partly delimiting and/or for at least partly forming the conveying space. Thus, an inner surface, which delimits the recess, of the conveying space element preferably forms a wall of the conveying space. The conveying element is preferably provided so as to be deformed, in particular elastically deformed, for a conveyance of a fluid. The conveying element is preferably provided so as to permit a conveyance of a fluid out of and/or through the conveying space as a result of a deformation of the conveying element. The conveying element is preferably deformable such that, for a conveyance of a fluid, the conveying element is movable in the direction of the recess and is in particular movable at least partly into said recess. It is thus advantageously possible to realize dynamic conveyance of a fluid or conveyance of a fluid with displacement action. For conveyance of a fluid with displacement action, the conveying element can preferably be caused, as a result of a deformation, to at least partly bear directly, in particular in form-fitting fashion, against the inner surface of the conveying space element. The conveying element is preferably in the form of a diaphragm pump element, in particular a flexurally rigid and/or spring-elastic diaphragm pump element. The conveying element is preferably formed so as to differ from a peristaltic pump element, in particular an expansion-flexible hose of a peristaltic pump device.

Here, the expression "conveying space" defines in particular a space which is delimited at least by the conveying element and by the conveying space element and which extends between the conveying element and the conveying space element at least from an inlet of the space, through which a fluid for conveying can be introduced into the space, to at least one outlet of the space, through which a conveying medium for conveying can be discharged from the space. It is preferable for the conveying space to extend between the conveying element and the conveying space element at least from a conveying space inlet of the conveying space to a conveying space outlet of the conveying space.

The conveying element is preferably, in a state of non-conveyance, arranged at least partly in convexly curved fashion on the conveying space element. For a conveyance of a fluid, the conveying element is preferably movable, in particular elastically deformable, in the direction of the conveying space element proceeding from a convex curvature oriented in a direction pointing away from the conveying space element, and is in particular movable at least partly into the concave recess of the conveying space element. For a conveyance of a fluid, the conveying element can preferably be changed at least partly from a convex curvature into a concave curvature. The conveying element can preferably be caused to bear at least partly against the inner surface, which delimits the concave recess of the conveying space element and which is oriented in particular in the direction of the conveying element, of the conveying space element, in particular owing to a drive force acting on the conveying element. It is very particularly preferably possible for at least one conveying surface of the conveying element to be caused to bear entirely against the inner surface of the conveying space element, which inner surface delimits the concave recess of the conveying space element, as a result of an elastic deformation, in particular a repeatable spring-elastic deformation, of the conveying element.

The expression "spring-elastic" is to be understood in particular to mean a characteristic of an element, which characteristic is provided in particular for generating an opposing force which is dependent on a change in a shape of the element and which is preferably proportional to the change and which counteracts the change. The conveying element is preferably repeatedly deformable without the conveying element thereby being mechanically damaged or destroyed. The spring-elastic form of the conveying element can preferably be at least partly influenced and/or realized by means of the convex arrangement on the conveying space element. The conveying element is preferably arranged on the conveying space element such that a fluid is conveyed in and/or through the conveying space as a result of an inward bulging of the conveying element. After an elimination of an action of a drive force on the conveying element for a conveyance of a fluid, the conveying element preferably at least substantially automatically seeks to re-assume the convexly curved arrangement on the conveying space element, in particular owing to the spring-elastic form. The conveying element is preferably produced from a spring steel or from a fiber composite material. It is however also conceivable for the conveying element to be produced from some other material which appears expedient to a person skilled in the art and which permits a spring-elastic form of the conveying element. The conveying element preferably utilizes a "bulging effect" for a conveyance of a fluid in and/or through the conveying space. The conveying element can preferably be at least temporarily inwardly bulged for a conveyance of a fluid, wherein at least one bulge is, for a conveyance of a fluid, displaceable at least along a longitudinal axis or a transverse axis, which runs at least substantially perpendicular to the longitudinal axis, of the conveying element. The conveying element is preferably of dimensionally stable form. Here, "dimensionally stable" is to be understood to mean that the conveying element is formed so as to be resilient in terms of shape with respect to pressure, heat or the like. By means of the embodiment according to the invention, it is advantageously possible to permit efficient conveyance of a fluid, in particular with a small number of components. It is furthermore advantageously possible for an internal stress, in particular an internal mechanical stress, of the conveying element to be utilized for a conveyance of a fluid.

The conveying element may be connected along an entire circumference, in particular as viewed in at least one plane, in at least substantially non-releasable fashion to the conveying space element, or the conveying element may be connected by means of at least one single side in at least substantially non-releasable fashion to the conveying space element, for example by means of a film hinge or the like. The conveying element and the conveying space element are preferably formed in one piece, for example by means of an injection molding process or the like, in particular with an at least substantially non-releasable connection of the conveying element and of the conveying space element by means of a film hinge or the like. The conveying element and the conveying space element are preferably formed from an identical material, for example plastic. It is however also conceivable for the conveying element and the conveying space element to be formed from different materials and to be connected to one another in at least substantially non-releasable fashion.

By means of the embodiment of the conveying device according to the invention, it is advantageously possible to permit convenient exchangeability of individual components and/or units in order, in particular, to permit a demand for at least substantially sterile use or in order to permit fast replacement of defective components and/or units. Furthermore, by means of the embodiment according to the invention, it is advantageously possible to realize a conveying device which has a small number of components and which can be of advantageously compact design. It is advantageously possible to realize a conveying device which permits an exchange at least of the conveying element and of the conveying space element in a manner similar to an ink or printer cartridge. Furthermore, by means of the embodiment according to the invention, it is possible to realize a preload in the conveying element in a simple manner in terms of construction, which preload can be utilized for a conveyance of a fluid in the manner of a traveling wave. Furthermore, by means of the embodiment according to the invention, it is advantageously possible to permit a captive arrangement of the conveying element on the conveying space element. Furthermore, it is advantageously possible for production of the conveying element and of the conveying space element to be realized in a small number of production method steps, in particular in at least one single injection molding method step. It is thus possible to achieve inexpensive production of the conveying element and of the conveying space element.

It is furthermore proposed that the conveying device comprises at least one conveying medium store unit for storing a conveying medium, in particular a fluid, wherein the conveying medium store unit forms the exchangeable unit together with the conveying space element and the conveying element. It is however also conceivable for the conveying medium store unit to be formed separately from the exchangeable unit, in particular in an alternative embodiment of the conveying device and/or of the pump device. Here, a "conveying medium store unit" is to be understood in particular to mean a unit which has at least one storage space in which a conveying medium, in particular a fluid, can be stored. It is preferable for a volume of the storage space of the conveying medium store unit to be larger than the conveying space, which is formed at least by the conveying element and the conveying space element. The conveying medium store unit is preferably formed in the manner of a tank. Here, the conveying medium store unit may be in the form of a carpule, an ampule, a cartridge or the like. The conveying medium store unit is preferably arranged adjacent to the conveying space inlet of the conveying space which is formed at least by the conveying element and by the conveying space element. The conveying medium store unit is preferably connected in terms of flow to the conveying space which is formed at least by the conveying element and by the conveying space element. It is preferable for an outlet of the conveying medium store unit to be connected, in particular connected in fluid-tight fashion, by means of at least one duct of the conveying device to the conveying space inlet of the conveying space which is formed at least by the conveying element and by the conveying space element. A fluid stored in the storage space of the conveying medium store unit can thus advantageously be conveyed out of the storage space by means of an interaction of the conveying element and conveying space element. By means of the embodiment according to the invention, it is particularly advantageously possible to realize a conveying device which is suitable for at least substantially sterile use, because an exchange of the exchangeable unit comprising at least the conveying medium store unit and the conveying space element and a conveying element is possible in a particularly convenient manner. In particular if a fluid provided for a medication is stored in the store unit and the fluid is conveyed through the conveying space, it is advantageously possible to perform a complete exchange of the exchangeable unit comprising at least the conveying medium store unit and the conveying space element and the conveying element in order to at least substantially prevent contaminated further use of the conveying medium store unit and of the conveying space element and of the conveying element.

It is furthermore proposed that the conveying medium store unit is connected to the conveying space element in an at least substantially non-releasable manner. Here, the expression "at least substantially non-releasable" is to be understood in particular to mean a connection of at least two elements which is separable only with the aid of cutting tools, such as for example a saw, in particular a mechanical saw etc., and/or chemical separating agents, such as for example solvents etc. The conveying medium store unit is preferably connected to the conveying space element in an at least substantially non-releasable manner at least by an operator and/or user of the conveying device. A connection between the conveying medium store unit and the conveying space element is preferably sealed. It is thus advantageously possible for unauthorized separation of the conveying medium store unit and conveying space element to be identified. It is advantageously possible for inadmissible re-use to be advantageously prevented, and for compliance with single use to be advantageously ensured. By means of the embodiment according to the invention, it is advantageously possible to achieve easy exchangeability of the conveying medium store unit together with the conveying space element and in particular together with the conveying element.

It is furthermore proposed that the conveying element is preferably configured for sealing at least one edge region of the conveying space element, which delimits the conveying space, said sealing being realized in particular in at least a state in which the conveying element is arranged on the conveying space element. The conveying element can preferably be arranged on the conveying space element such that the at least one edge region of the conveying space element, which delimits the conveying space, can be sealed. Sealing of the at least one edge region of the conveying space element, which delimits the conveying space, may be realized directly by means of the conveying element. It is however alternatively or additionally also conceivable for a seal element of the conveying device to be provided which can be arranged between the conveying element and the conveying space element, in particular on the at least one edge region of the conveying space element, which delimits the conveying space. The seal element of the conveying device may be formed as a rubber seal, as a sealing cord, as a sealing lip, as a flexible seal compound, as a fiber seal, as a paper seal or the like. With the embodiment according to the invention, it is possible in a simple manner in terms of construction to realize an at least substantially leakage-free conveyance of a fluid. In a particularly preferred embodiment of the conveying device according to the invention, additional seal elements can advantageously be dispensed with. It is advantageously possible for installation outlay and components to be saved.

The expression "at least substantially" is to be understood, in particular at least in conjunction with extents and/or dimensioning, to mean that a deviation deviates from a predefined value by in particular less than 25%, preferably less than 10%, particularly preferably less than 5% of the predefined value, and very particularly preferably corresponds entirely to the value. It is particularly preferable if the conveying element comprises at least one conveying surface which, viewed in a cross-section of the conveying element, has a maximum transverse extent which is equivalent to, in particular entirely equivalent to or congruent with, a maximum transverse extent of a rigid wall of the conveying space element, which wall at least partly delimits at least the conveying space. It may also conceivably be provided that, in an unloaded state of the conveying element, the maximum transverse extent of the conveying surface of the conveying element is equivalent to the maximum transverse extent of the rigid wall of the conveying space element, which wall at least partly delimits at least the conveying space. It is preferable for the maximum transverse extent of the conveying surface to run at least substantially transversely, in particular at least substantially perpendicularly, to a conveying direction in the conveying space. The conveying direction in the conveying space preferably runs from the conveying space inlet to the conveying space outlet. Here, the expression "at least substantially transversely" is to be understood in particular to mean an orientation of a direction and/or of an axis relative to a reference direction and/or a reference axis, wherein the orientation of the direction and/or of the axis is at least different from an at least substantially parallel orientation with respect to the reference direction and/or with respect to the reference axis and is in particular skewed or perpendicular with respect to the reference direction and/or with respect to the reference axis. Here, the expression "at least substantially perpendicular" is intended in particular to define an orientation of a direction relative to a reference direction, wherein the direction and the reference direction, viewed in particular in one plane, enclose an angle of 90° and the angle has a maximum deviation of in particular less than 8°, advantageously less than 5° and particularly advantageously less than 2°. By means of the embodiment according to the invention, it is advantageously possible to permit reduced loading of the conveying element as a result of a deformation. Furthermore, it is advantageously possible to achieve a high level of variability with regard to an activation of the conveying device.

Furthermore, the invention is based on a pump device with at least one conveying device according to the invention and with at least one drive unit for driving the conveying device. It is proposed that the drive unit is embodied as a helical drive unit, wherein at least one drive axis of a drive element of the drive unit extends at least substantially parallel to a conveying direction of the conveying device. The conveying element can preferably be driven by means of the drive unit such that a conveyance of a fluid in accordance with a traveling-wave principle can be made possible. The drive unit may be in the form of a mechanical drive unit, a magnetic drive unit, a piezoelectric drive unit, a hydraulic drive unit, a pneumatic drive unit, an electric drive unit, a magnetorheological drive unit, a carbon tubes drive unit, a combination of one of the said types of drive units, or some other drive unit that appears expedient to a person skilled in the art. It is alternatively also conceivable for the pump device to be operable manually, in particular by hand. In an embodiment of the pump device as a manual operable pump device, a fluid can be at least transported into the conveying space as a result of the action of a force exerted on the conveying element by a hand, in particular by at least one finger, of an operator, and/or can be at least transported out of the conveying space as a result of the action of a force exerted on the conveying element by a hand, in particular by at least one finger, of an operator. The manual operable pump device preferably comprises at least one valve unit, which has for example at least one valve, in particular a one-way valve (for example check valve or the like) at a conveying space inlet and at least one valve, in particular a one-way valve (for example check valve or the like) at a conveying space outlet. The drive unit preferably comprises at least one drive element which is provided so as to act on the conveying element, in particular is provided so as to effect an elastic deformation, in particular a repeatable spring-elastic deformation, of the conveying element as a result of an action of a drive force on the conveying element. The drive element may be designed in any form that appears expedient to a person skilled in the art, and may for example be designed as a plunger, as a projection, as a helix, as a cam, as an eccentric or the like. The drive element is preferably provided for acting directly on the conveying element. It is however also conceivable for at least one further element or further elements to be arranged between the drive element and the conveying element, such as for example a friction-reducing element, a support element or the like. The pump device preferably comprises at least one housing unit on which the exchangeable unit can be arranged in a releasable fashion. By means of the embodiment according to the invention, it is advantageously possible to realize a pump device which permits convenient exchangeability of individual components and/or units in order, in particular, to permit a demand for at least substantially sterile use or in order to permit fast replacement of defective components and/or units.

Here, a "helical drive unit" is to be understood in particular to mean a drive unit which has at least one helical drive element which is provided in particular for subjecting the conveying element to the action of a drive force, in particular to the direct action of a drive force. The drive unit preferably comprises at least one drive element of helical form. By means of the embodiment according to the invention, it is advantageously possible to realize a compact construction of the pump device.

Here, the expression "at least substantially parallel" is to be understood in particular to mean an orientation of a direction relative to a reference direction, in particular in one plane, wherein the direction has a deviation relative to the reference direction of in particular less than 8°, advantageously less than 5° and particularly advantageously less than 2°. In the case of an embodiment of the drive unit as a helical drive unit or as an eccentric drive unit, it is preferably the case that an axis of rotation of the drive element of helical form, which axis of rotation forms the drive axis of the drive unit, runs at least substantially parallel to the conveying direction in the conveying space. It is preferable for an axis of rotation of a rotor element of an electric motor unit of the drive unit to run at least substantially parallel to the conveying direction in the conveying space. The axis of rotation of the rotor element of the electric motor unit preferably forms a further drive axis, which runs at least substantially parallel to the conveying direction in the conveying space. By means of the embodiment according to the invention, it is advantageously possible to realize a particularly compact pump device, which is in particular of flat construction.

It is furthermore conceivable, in particular in a further alternative embodiment of the pump device, that the drive unit is implemented as a plate disk drive unit. Here, a "plate disk drive unit" is to be understood in particular to mean a drive unit which has at least one drive element which, for an action of a drive force, in particular a direct action of a drive force, on the conveying element, is arranged on a plate element which can be driven in rotation, wherein it is provided in particular that the drive element, for an action of a drive force on the conveying element, extends at least substantially parallel to an axis of rotation of the plate element. It is preferable if the drive element for an action of a drive force on the conveying element is implemented as a cam. The drive element is preferably formed in one piece with the plate element. It is however also conceivable, alternatively to the embodiments mentioned above, for the drive unit to be of some other design that appears expedient to a person skilled in the art, for example designed as a funnel-type drive unit, as a ring-type drive unit or the like. By means of the embodiment of the drive unit as a plate disk drive unit, it is advantageously possible to realize a compact structural form of the pump device. It is advantageously possible to realize a large conveying space volume within a small footprint.

It is also proposed that at least one drive axis of the drive unit extends at least substantially transversely to the conveying direction of the conveying device, in particular in the case of an embodiment of the drive unit as a plate disk drive unit. The drive axis of the drive unit implemented as a plate disk drive unit preferably runs at least substantially perpendicularly with respect to the conveying direction in the conveying space or through the conveying space of the conveying device. It is preferable for at least one axis of rotation, which forms the drive axis, of a rotor element of an electric motor unit of the drive unit implemented as a plate disk drive unit to run at least substantially perpendicular to the conveying direction in the conveying space. In an embodiment of the drive unit as a plate disk drive unit, it is preferable for an axis of rotation of the plate element to run at least substantially perpendicular to the conveying direction in the conveying space. By means of the embodiment according to the invention, it is particularly advantageously possible for an installation space to be utilized for a drive of the conveying device.

The invention furthermore relates to a pump device with at least one conveying device according to the invention and with at least one drive unit for driving the conveying device. It is proposed that the drive unit is implemented as a paternoster drive unit comprising at least one force action element, which is drivable, for the purpose of an action of a drive force, in particular a direct action of a drive force, onto the conveying element, in a circulating fashion, wherein, for an action of a drive force onto the conveying element, the force action element extends at least substantially parallel to a circulation plane, in particular in the circulation plane in which the force action element is drivable in a circulating operation, wherein the force action element of the drive unit, which is embodied as a paternoster drive unit, is arranged on a wrap-around element of the drive unit, which is embodied as a paternoster drive unit, in particular in an alternative embodiment of the pump device according to the invention. The force action element of the drive unit implemented as a paternoster drive unit is arranged on, in particular formed in one piece with, a wrap-around element of the drive unit implemented as a paternoster drive unit. The wrap-around element may be formed as a belt, as a band, as a chain, as a cord or the like. The wrap-around element can preferably be tensioned by means of at least two deflection elements, in particular sprockets, of the drive unit implemented as a paternoster drive unit. In particular, the wrap-around element can be driven in circulating fashion around the deflection elements as a result of a rotating drive movement of at least one of the at least two deflection elements. It is preferable for at least one of the at least two deflection elements to be connected rotationally conjointly to a rotor element, in particular to a rotor shaft, of the drive unit implemented as a paternoster drive unit. It is preferable for at least one of the at least two deflection elements to be mounted rotatably without a drive. It is preferable if a drive force which can be generated as a result of a rotation of the rotor element can be transmitted by means of the wrap-around element from the deflection element connected rotationally conjointly to the rotor element to the deflection element mounted rotatably without a drive. By means of the embodiment of the drive unit according to the invention, it is advantageously possible to realize an effective arrangement of force introduction points on the force action element of the drive unit implemented as a paternoster drive unit for an action of a drive force on the conveying element. It is advantageously possible for a particularly effective arrangement of a plurality of force introduction points on the wrap-around element of the drive unit implemented as a paternoster drive unit to be permitted in a manner dependent on at least one conveying characteristic variable, for example a conveying rate, a conveying speed or the like.

It is also proposed that at least one drive axis of the drive unit extends at least substantially transversely to the conveying direction of the conveying device, in particular in the case of an embodiment of the drive unit as a paternoster drive unit. The drive axis of the drive unit implemented as a paternoster drive unit preferably runs at least substantially perpendicularly with respect to the conveying direction in the conveying space or through the conveying space of the conveying device. It is preferable for at least one axis of rotation, which forms the drive axis, of a rotor element of an electric motor unit of the drive unit implemented as a paternoster drive unit to run at least substantially perpendicular to the conveying direction in the conveying space. By means of the embodiment according to the invention, it is particularly advantageously possible for an installation space to be utilized for a drive of the conveying device.

Here, it is not the intention for the conveying device according to the invention and/or the pump device according to the invention to be restricted to the usage and embodiment described above. In particular, in order to perform a function described herein, the conveying device according to the invention and/or the pump device according to the invention may have a number of individual elements, components and units and method steps which differs from a number mentioned herein. Furthermore, with regard to the value ranges specified in this disclosure, it is also intended that values lying within the stated limits are disclosed and usable as desired.

DRAWINGS

Further advantages emerge from the following description of the drawings. The drawings illustrate exemplary embodiments of the invention. The drawings, the description and the claims contain numerous features in combination. A person skilled in the art will expediently also consider the features individually and combine these to form further meaningful combinations.

Figure 2:
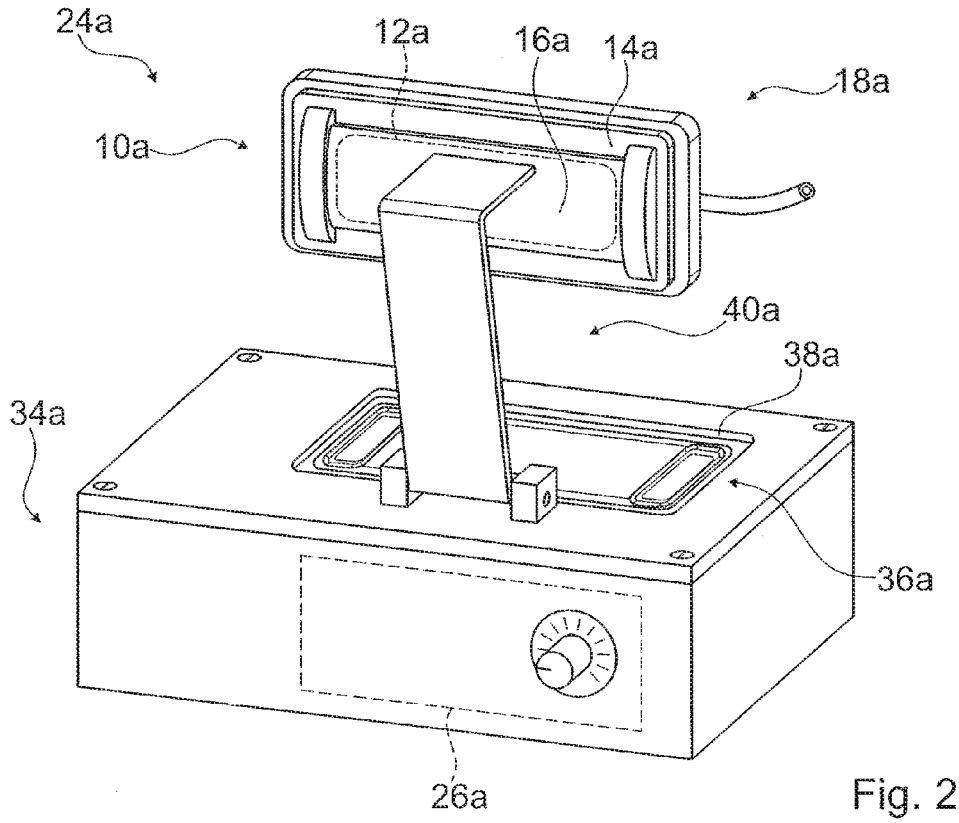
Figure 3:
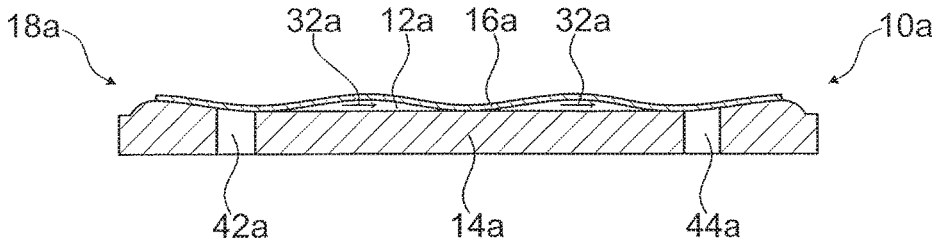
Figure 4:
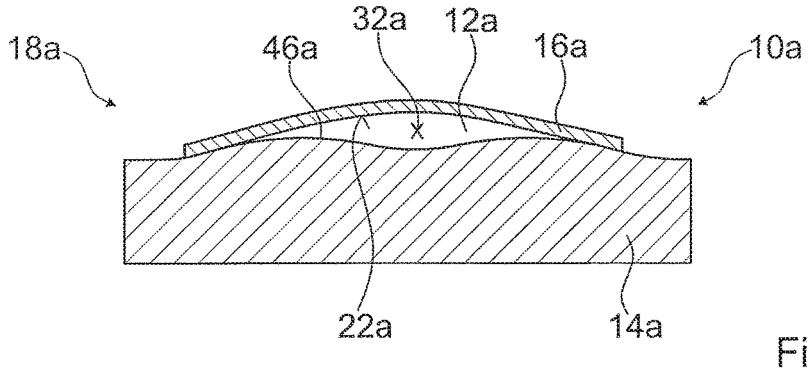
Figure 5:
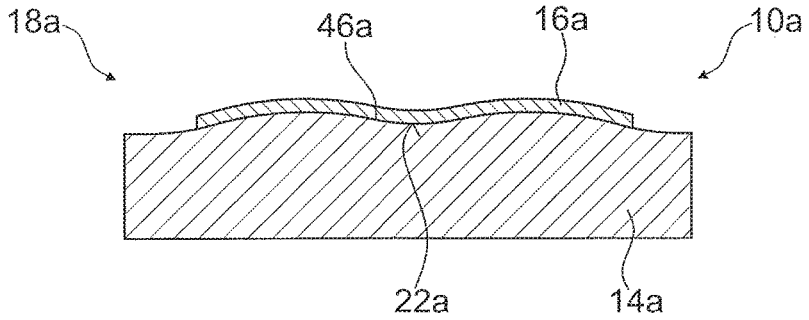
Figure 6:
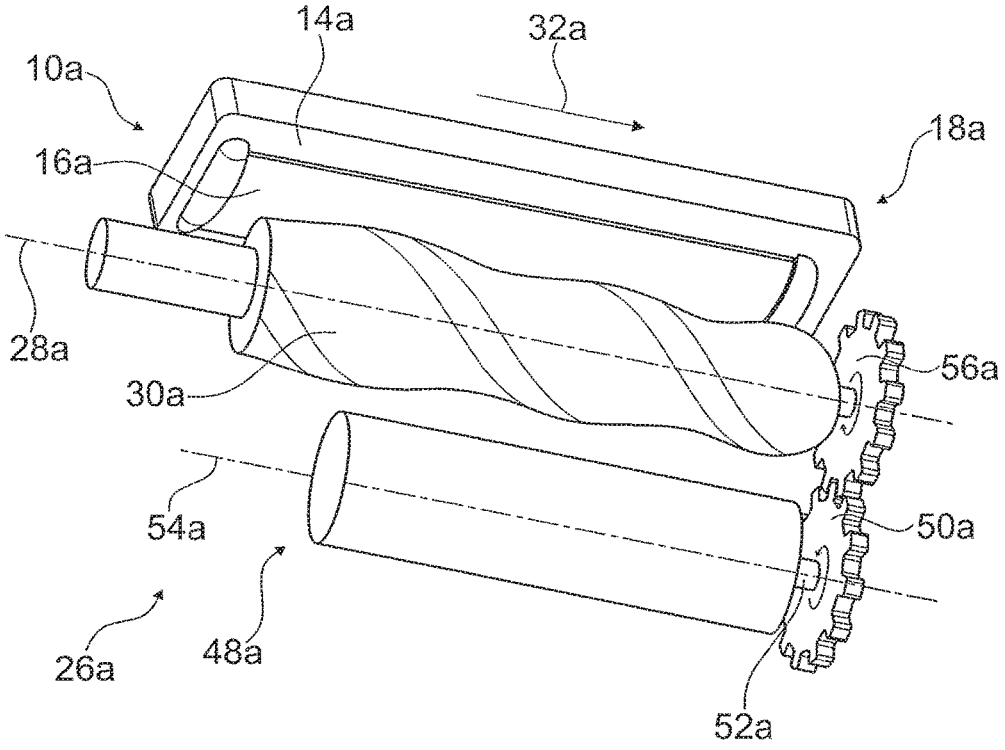
Figure 7:
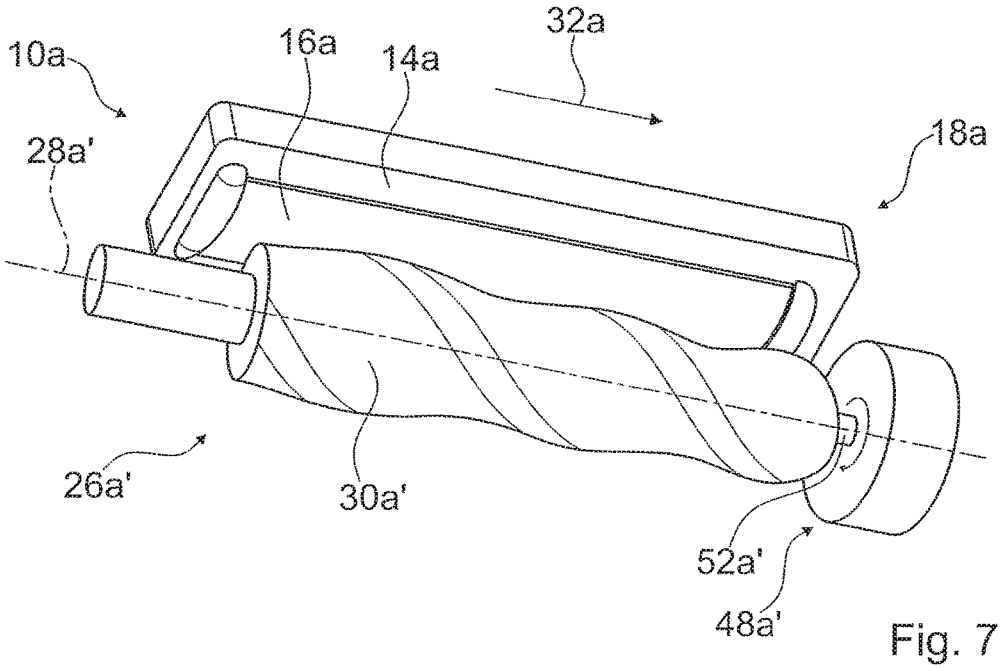
Figure 8:
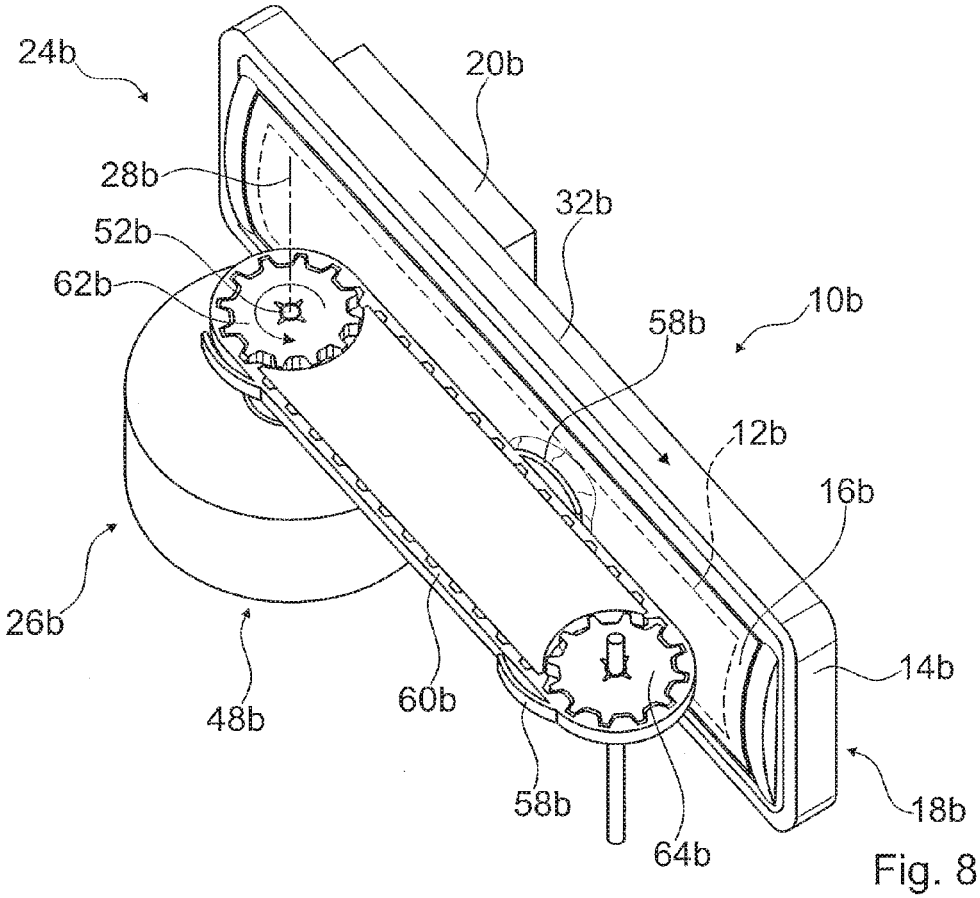
Figure 9:
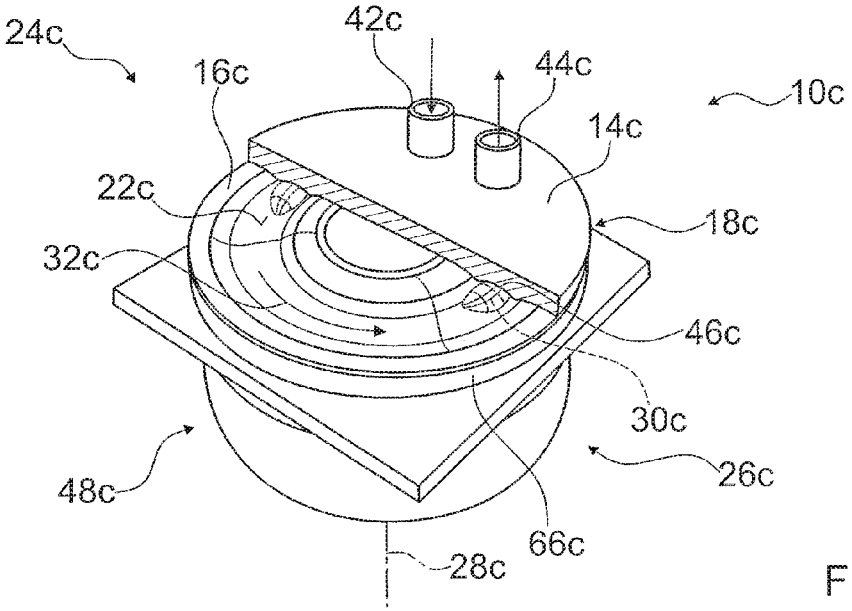
Figure 10:
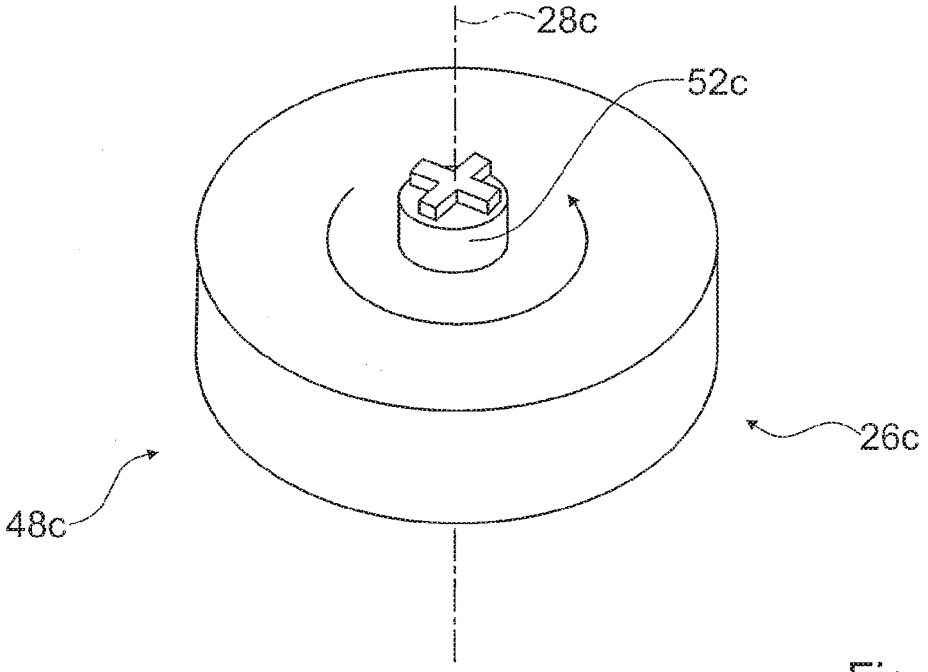
Figure 11:
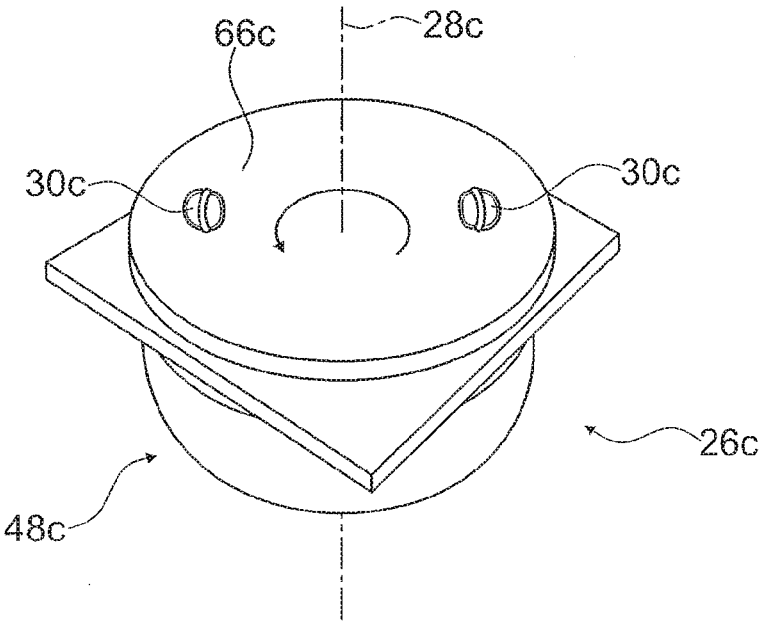
Figure 12:
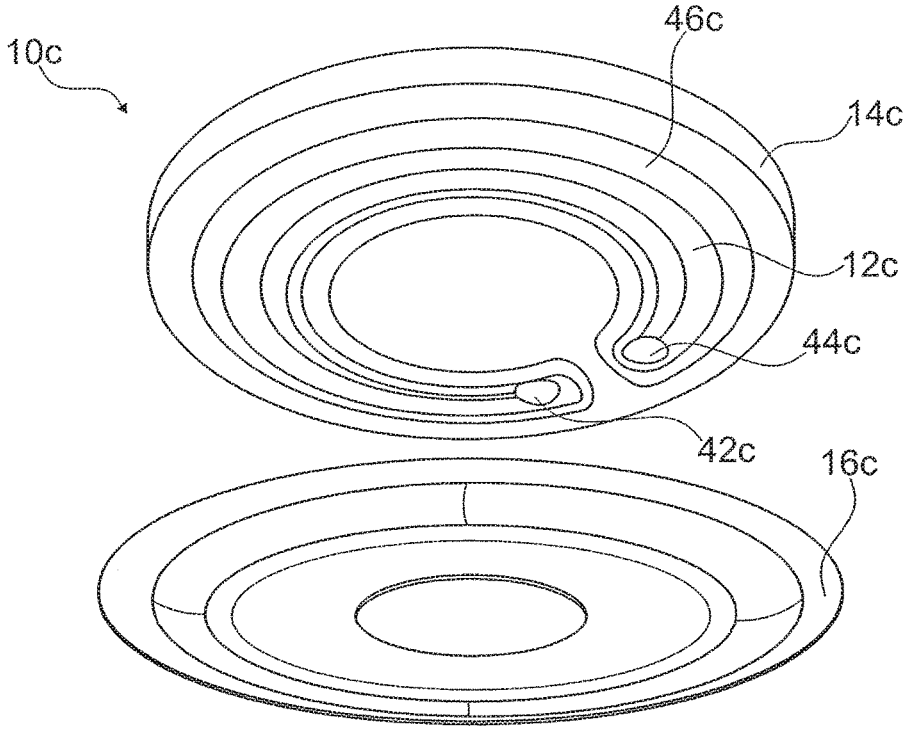
Figure 13:
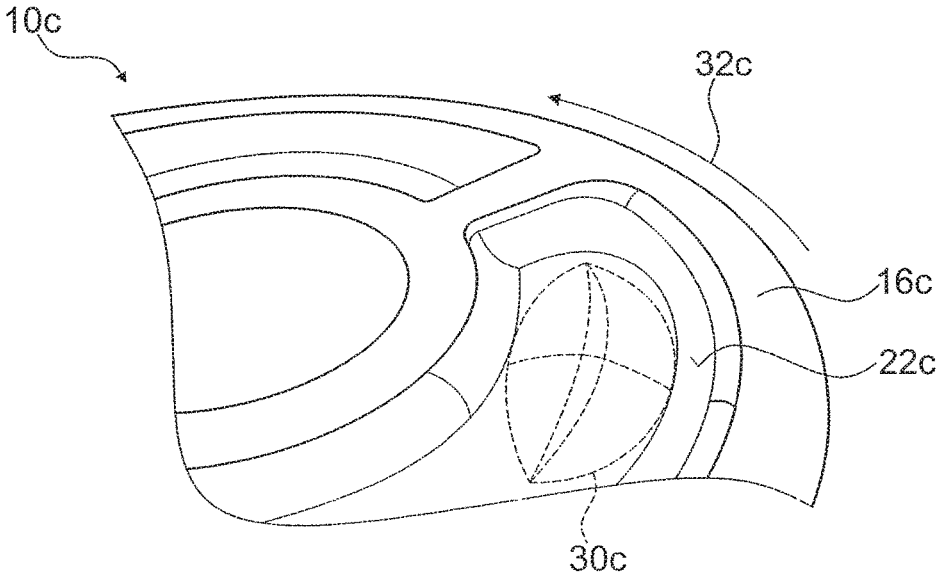

In the drawings:

FIG. 1 shows a pump device according to the invention with at least one conveying device according to the invention in a schematic illustration, FIG. 2 shows the pump device according to the invention with a removed exchangeable unit in a schematic illustration, FIG. 3 shows a longitudinal section through a conveying space of the conveying device according to the invention, which conveying space is formed by a conveying element and by a conveying space element of the conveying device according to the invention, in a schematic illustration, FIG. 4 shows a cross-section through the conveying space in a load-free state of the conveying element in a schematic illustration, FIG. 5 shows a cross-section through the conveying space in a loaded state of the conveying element in a schematic illustration, FIG. 6 shows a detailed view of a drive unit of the pump device according to the invention, which is provided for driving the conveying device according to the invention, in a schematic illustration, FIG. 7 shows a detailed view of an alternative drive unit of the pump device according to the invention, which is provided for driving the conveying device according to the invention, in a schematic illustration, FIG. 8 shows a detailed view of a further alternative drive unit of the pump device according to the invention, which is provided for driving the conveying device according to the invention, in a schematic illustration, FIG. 9 shows a detailed view of a further alternative drive unit of the pump device according to the invention, which is provided for driving an alternative conveying device according to the invention, in a schematic illustration, FIG. 10 shows a detail view of a motor unit of the further alternative drive unit of the pump device according to the invention from FIG. 9, in a schematic illustration, FIG. 11 shows a detail view of a drive element, arranged on the motor unit, of the further alternative drive unit of the pump device according to the invention from FIG. 9, in a schematic illustration, FIG. 12 shows an exploded view of the alternative conveying device according to the invention from FIG. 9 in a schematic illustration, and FIG. 13 shows a detail view of a conveying element of the alternative conveying device according to the invention from FIG. 9, in a schematic illustration.

DESCRIPTION OF THE EXEMPLARY EMBODIMENTS

FIGS. 1 and 2 show a pump device 24*a* with at least one conveying device 10*a* and with at least one drive unit 26*a* for driving the conveying device 10*a*. The pump device 24*a* comprises at least one housing unit 34*a* in which at least the drive unit 26*a* is arrangeable. The conveying device 10*a* is arrangeable on the housing unit 34*a*, in particular is arrangeable on the housing unit 34*a* in a releasable fashion. For an arrangement of the conveying device 10*a* on the housing unit 34*a*, the pump device 24*a* has at least one receiving unit 36*a*. The receiving unit 36*a* is arranged on the housing unit 34*a*. The receiving unit 36*a* comprises at least one receiving element 38*a* in which the conveying device 10*a* can be at least partly received. The receiving element 38*a* is implemented as a receiving recess into which the conveying device 10*a* can be at least partly placed. It is however also conceivable for the receiving unit 38*a* to be of some other design that appears expedient to a person skilled in the art, for example to be designed as a projection, as a rib, as a magnet or the like. For a fastening of the conveying device 10*a* in a state arranged on the housing unit 34*a*, the pump device 24*a* has a fastening unit 40*a*. The fastening unit 40*a* is arranged on the housing unit 34*a*. The fastening unit 40*a* is provided for fastening, in particular releasably fastening, the conveying device 10*a* to the housing unit 34*a* by means of a form-fitting and/or force-fitting connection. The fastening unit 40*a* may be implemented as a clamping unit, as a detent unit, as a screw unit or as some other unit that appears expedient to a person skilled in the art, which unit is provided for fastening the conveying device 10*a* to the housing unit 34*a* by means of a form-fitting and/or force-fitting connection.

The conveying device 10*a* is configured at least for conveying a fluid. The conveying device 10*a* comprises at least one conveying space 12*a*, at least one conveying space element 14*a*, which at least partly delimits the conveying space 12*a* and is embodied in a rigid fashion, and at least one elastically deformable conveying element 16*a*, which forms the conveying space 12*a* together with the conveying space element 14*a*. At least the conveying space element 14*a* and the conveying element 16*a* together form an exchangeable unit 18*a*. The exchangeable unit 18*a* is arrangeable on the housing unit 34*a* by means of the receiving unit 36*a*. The exchangeable unit 18*a* can be at least partly placed into the receiving element 38*a*. By means of the fastening unit 40*a*, the exchangeable unit 18*a* can be fastened to the housing unit 34 in a releasable fashion, in particular in a state arranged in the receiving unit 36*a*. FIG. 2 illustrates the pump device 24*a* with the exchangeable unit 18*a* of the conveying device 10*a* removed from the housing unit 34*a*.

Furthermore, the conveying device 10*a* comprises at least one conveying medium store unit 20*a* for storing a conveying medium, wherein the conveying medium store unit 20*a* forms the exchangeable unit 18*a* together with the conveying space element 14*a* and the conveying element 16*a*. The conveying medium store unit 20*a* is connected to the conveying space element 14*a* in an at least substantially non-releasable manner. It is however also conceivable, in an alternative embodiment of the conveying device 10*a* which is not illustrated in any more detail here, for the conveying medium store unit 20*a* of the conveying device 10*a* to not be a constituent part of the exchangeable unit 18*a*, and to be fluidically connectable, in particular connectable in a releasable manner, to the exchangeable unit 18*a*, in particular at least to the conveying space 12*a*, by means of a conveying line, such as for example a hose, of the conveying device 10*a* and for the exchangeable unit 18*a* to be removable from the housing unit 34*a* separately from the conveying medium store unit 20*a*.

FIG. 3 shows a longitudinal section through the conveying space 12*a* of the conveying device 10*a*, which conveying space is formed at least by the conveying element 16*a* and by the conveying space element 14*a* of the conveying device 10*a*. The conveying element 16*a* is of a polygonal, in particular rectangular, design. The conveying space element 14*a* is of a polygonal, in particular rectangular, design. The conveying medium store unit 20*a* is not illustrated in FIG. 3. The conveying element 16*a* is provided for sealing at least one edge region of the conveying space element 14*a*, which delimits the conveying space 12*a*. A fluid which can be conveyed in and/or through the conveying space 12*a* by means of an interaction of the fluid-conveying element 14*a* and of the conveying element 16*a* can be introduced into the conveying space 12*a* via a conveying space inlet 42*a* of the conveying device 10*a*. The conveying space inlet 42*a* is arranged on the conveying space element 14*a*, and is in particular formed in one piece with the conveying space element 14*a*. The conveying space inlet 42*a* is fluidically connected to the conveying medium store unit 20*a*, and in particular is fluidically connected to a storage space outlet (not illustrated in any more detail here) of the conveying medium store unit 20*a*. A fluid can be conveyed in and/or through the conveying space 12*a* by means of a reversible deformation of the conveying element 16*a*. A fluid can be conveyed from the conveying space inlet 42*a* through the conveying space 12*a* to a conveying space outlet 44*a* of the conveying device 10*a* by means of a reversible deformation of the conveying element 16*a*. The conveying space inlet 44*a* is arranged on the conveying space element 14*a*, and is in particular formed in one piece with the conveying space element 14*a*. The conveying space outlet 44*a* is fluidically connected to a further unit (not illustrated in any more detail here). The further unit may in this case be a part of the pump device 24*a*, a part of an administration device on which the pump device 24*a* is arranged, a part of a household appliance on which the pump device 24*a* is arranged, or the like. In an embodiment of the pump device 24*a* as part of an administration device, it is in particular conceivable for the further unit to be in the form of an injection unit, in particular in the form of a needle or syringe unit. The further unit may be directly connected to the conveying space outlet 44*a*, or the further unit may be fluidically connected to the conveying space outlet 44*a* by means of a separate conveying line, for example a hose. Further fluidic connections of the further unit to the conveying space outlet 44*a* that appear expedient to a person skilled in the art are likewise conceivable.

FIG. 4 shows a cross-section through the conveying space 12*a*, wherein the conveying element 16*a* is illustrated in a load-free state. In particular, no conveyance of a fluid occurs in an unloaded state of the conveying element 16*a*. The conveying element 16*a* is arrangeable on the conveying space element 14*a* in an at least partly convexly curved fashion. The conveying element 16*a* is, at least in a load-free state, in particular in a state in which it is not loaded by the action of a drive force that can be generated by means of the drive unit 26*a*, arranged on the conveying space element 14*a* in an at least partly convexly curved fashion. The conveying space element 14*a* has at least one concave recess 46*a* for at least partly delimiting and/or for at least partly forming the conveying space 12*a*. An inner surface, which delimits the recess 46*a*, of the conveying space element 14*a* forms a wall of the conveying space 12*a*. The conveying element 16*a* is deformable such that, for a conveyance of a fluid, the conveying element 16*a* is movable in the direction of the recess 46*a* and is in particular movable at least partly into said recess (FIG. 5). The conveying element 16*a* is of spring-elastic form. The conveying element 16*a* is connected to the conveying space element 14*a* in an at least substantially non-releasable manner, in particular in an edge region, which delimits the recess 46*a*, of the conveying space element 14*a*. The at least substantially non-releasable connection of the conveying element 16*a* to the conveying space element 14*a* forms, in particular, a seal between the conveying element 16*a* and the conveying space element 14*a*. It is however also conceivable for an additional seal element of the conveying device 10*a* to be arranged between the conveying element 16*a* and the conveying space element 14*a*. The conveying space 12*a* can preferably be sealed in fluid-tight fashion preferably as a result of a connection and/or arrangement of the conveying element 16*a* to and/or on the conveying space element 14*a*.

The conveying element 16*a* comprises at least one conveying surface 22*a* which, viewed in a cross-section of the conveying element 16*a*, in particular in a cross-section of the conveying space 12*a*, has a maximum transverse extent which is at least substantially equivalent to a maximum transverse extent of the wall of the conveying space element 14*a*, which wall delimits the conveying space 12*a*, in particular of the inner surface, which delimits the recess 46*a*, of the conveying space element 14*a* (FIGS. 4 and 5). It is particularly preferable if the conveying element 16*a* comprises at least one conveying surface 22*a* which, viewed in a cross-section of the conveying element 16*a*, has a maximum transverse extent which is equivalent to a maximum transverse extent of a rigid wall of the conveying space element 14*a*, which wall at least partly delimits at least the conveying space 12*a*. For a conveyance of a fluid in and/or through the conveying space 12*a*, the conveying surface 22*a* can, as a result of the action of a drive force that can be generated by the drive unit 26*a*, be caused to bear, in particular be caused to bear entirely, against the wall of the conveying space element 14*a*, which wall delimits the conveying space 12*a*, in particular against the inner surface, which delimits the recess 46*a*, of the conveying space element 14*a* (FIG. 5).

FIG. 6 shows a detail view of the drive unit 26*a*. For control and/or regulation of the drive unit 26*a*, the pump device 24*a* comprises at least one control and/or regulation unit (neither of which is illustrated here), which is of a design already known to a person skilled in the art. The drive unit 26*a* is implemented as a helical drive unit. At least one drive axis 28*a* of a drive element 30*a* of the drive unit 26*a* runs at least substantially parallel to a conveying direction 32*a* of the conveying device 10*a*, in particular at least substantially parallel to a conveying direction 32*a* through the conveying space 12*a*. The drive element 30*a* is implemented as a drive helix. The drive element 30*a* is supported rotatably in the housing unit 34*a*. The drive axis 28*a* is configured as an axis of rotation of the drive element 30*a*. The drive element 30*a* is provided for deforming the conveying element 16*a* for a conveyance of a fluid. The drive element 30*a* is provided for generating a traveling-wave movement of the conveying element 16*a* along a longitudinal axis of the conveying element 16*a*. Here, it is conceivable for the drive element 30*a* to act directly on the conveying element 16*a*, or for an exciter element (not illustrated in any more detail here) to be arranged between the drive element 30*a* and the conveying element 16*a*, which exciter element is acted on directly by the drive element 30*a*, wherein the exciter element transmits an action of drive forces to the conveying element 16*a*, which bears at least partly against the exciter element.

For a movement, in particular a rotation, of the drive element 30*a*, the drive unit 26*a* comprises at least one motor unit 48*a*. The motor unit 48*a* is formed as an electric motor unit. It is however also conceivable for the motor unit 48*a* to be of some other design that appears expedient to a person skilled in the art, for example to be designed as a combustion engine unit, as a hybrid motor unit or the like. The drive unit 26*a* furthermore has at least one sprocket element 50*a* which is arranged rotationally conjointly on a rotor shaft 52*a* of the motor unit 48*a*. The rotor shaft 52*a* has an axis of rotation 54*a* which runs at least substantially parallel to the drive axis 28*a* of the drive element 30*a*. The sprocket element 50*a* is implemented as a pinion. Here, the sprocket element 50*a* may be formed in one piece with the rotor shaft 52*a*, or the sprocket element 50*a* may be implemented separately from the rotor shaft 52*a*, wherein the sprocket element 50*a* is connected rotationally conjointly to the rotor shaft 52*a* by means of a form-fitting and/or force-fitting connection. Furthermore, the drive unit 26*a* comprises at least one transfer element 56*a* which is provided for transmitting a rotational movement of the rotor shaft 52*a* and of the sprocket element 50*a* to the drive element 30*a*. The transfer element 56*a* is implemented as a sprocket which meshes with the sprocket element 50*a*. The transfer element 56*a* is supported rotatably in the housing unit 34*a*. An axis of rotation of the transfer element 56*a* runs at least substantially parallel to the axis of rotation 54*a* of the rotor shaft 52*a* and in particular, axially with respect to the drive axis 28*a* of the drive element 30*a*. Furthermore, the transfer element 56*a* is connected rotationally conjointly to the drive element 30*a*.

FIG. 7 shows an alternative embodiment of a drive unit 26*a*' for driving the conveying device 10*a*. By contrast to the drive unit 26*a* illustrated in FIG. 6, the drive unit 26*a*' illustrated in FIG. 7 is configured so as to be decoupled from the sprocket element 50*a* and from the transfer element 56*a*. A drive element 30*a*' of the drive unit 26*a*' illustrated in FIG. 7 is connected rotationally conjointly to a rotor shaft 52*a*' of the drive unit 26*a*' illustrated in FIG. 7. With regard to further features and functions of the drive unit 26*a*' illustrated in FIG. 7, reference may be made to the drive unit 26*a* described in the description of FIGS. 1 to 6, in particular of FIG. 6.

FIGS. 8 to 13 show further exemplary embodiments of the invention. The following descriptions and drawings are restricted substantially to the differences between the exemplary embodiments, wherein, with regard to components with identical designation, in particular with regard to components with the same reference numerals, reference may basically also be made to the drawings and/or to the description of the other exemplary embodiments, in particular of FIGS. 1 to 7. To distinguish between the exemplary embodiments, the alphabetic character a has been added as a suffix to the reference numerals of the exemplary embodiment in FIGS. 1 to 7. In the exemplary embodiments of FIGS. 8 to 13, the alphabetic character a has been replaced by the alphabetic characters b and c.

FIG. 8 shows a detail view of an alternative drive unit 26*b* of a pump device 24*b* for driving a conveying device 10*b*. The pump device 24*b* and the conveying device 10*b* are in each case of an at least substantially analogous embodiment in relation to the pump device 24*a* and the conveying device 10*a* described in FIGS. 1 to 6, such that here, the embodiment of the pump device 24*a* and the embodiment of the conveying device 10*b* will not be discussed in any more detail here. The drive unit 26*b* is implemented as a paternoster drive unit. At least one drive axis 28*b* of a drive element 30*b* of the drive unit 26*b* runs at least substantially transversely with respect to a conveying direction 32*b* of the conveying device 10*b*, in particular at least substantially transversely with respect to a conveying direction 32*b* in and/or through a conveying space 12*b* of the conveying device 10*b*. The drive element 30*b* is implemented as a rotor shaft 52*b* of a motor unit 48*b* of the drive unit 26*b*. At least one axis of rotation, which forms the drive axis 28*b*, of the rotor shaft 52*b* preferably runs at least substantially perpendicular to the conveying direction 32*b* in and/or through the conveying space 12*b*. The motor unit 48*b* is formed as an electric motor unit. It is however also conceivable for the motor unit 48*b* to be of some other design that appears expedient to a person skilled in the art, for example to be designed as a combustion engine unit, as a hybrid motor unit or the like. The drive unit 26*b* comprises at least one force action element 58*b*. The force action element 58*b* is arranged on a wrap-around element 60*b* of the drive unit 26*b*, and in particular is formed in one piece therewith. Altogether, the drive unit 26*b* may have a multiplicity of force action elements 58*b*, which are arranged on the wrap-around element 60*b*. Here, it would be possible for the force action elements 58*b*, viewed along an overall longitudinal profile of the wrap-around element 60*b*, to be arranged on the wrap-around element 60*b* so as to be spaced apart from one another uniformly or spaced apart from one another non-uniformly. The wrap-around element 60*b* may be formed as a belt, in particular as a toothed belt, as a band, as a chain, as a cord or the like. The wrap-around element 60*b* can be tensioned and/or driven in circulating fashion by means of at least two deflection elements 62*b*, 64*b*, in particular sprockets, of the drive unit 26*b*. It is preferable for at least one of the at least two deflection elements 62*b*, 64*b* to be connected rotationally conjointly to the rotor shaft 52*b* of the drive unit 26*b*. One of the at least two deflection elements 62*b*, 64*b* is rotatably mounted without a drive. The force action element 58*b* or the force action elements 58*b* extend(s) at least substantially parallel to a circulation plane in which the wrap-around element 60*b* can be driven in circulating fashion. With regard to further features and functions of the drive unit 26*b* illustrated in FIG. 8, reference may be made to the drive unit 26*a* described in the description of FIGS. 1 to 6, in particular of FIG. 6.

FIGS. 9 to 13 show an alternative pump device 24*c* with an alternative conveying device 10*c* and with an alternative drive unit 26*c* for driving the conveying device 10*c*. The conveying device 10*c* at least for conveying a fluid comprises at least one conveying space 12*c*, at least one conveying space element 14*c*, which at least partly delimits the conveying space 12*c* and is embodied in a rigid fashion, and at least one elastically deformable conveying element 16*c*, which forms the conveying space 12*c* together with the conveying space element 14*c*. The conveying space element 14*c* and the conveying element 16*c* together form an exchangeable unit 18*c*. A mode of operation of the conveying device 10*c* illustrated in FIGS. 9 to 13 is at least substantially analogous to a mode of operation of the conveying device 10*a* illustrated in FIGS. 1 to 6. By contrast to the conveying device 10*a* illustrated in FIGS. 1 to 6, the conveying device 10*c* illustrated in FIGS. 9 to 13 has the conveying element 16*c*, which has a circular-disk-shaped form (FIG. 12). Furthermore, by contrast to the conveying device 10*a* illustrated in FIGS. 1 to 6, the conveying device 10*c* illustrated in FIGS. 9 to 13 has the conveying element 14*c*, which has a circular-disk-shaped form (FIG. 12). The conveying space element 14*c* and the conveying element 16*c* delimit the conveying space 12*c*, which is of annular-segment-shaped form. To form the conveying space 12*c*, the conveying element 16*c* has a convexly curved region. Viewed along a circumferential direction of the conveying device 10*c*, the convexly curved region extends over less than 360°. To form the conveying space 12*c*, the conveying space element 14*c* has a concave recess 46*c*. Viewed along the circumferential direction, the concave recess 46*c* extends over less than 360°. Viewed along the circumferential direction, the conveying space 12*c* extends over less than 360° from a conveying space inlet 42*c* of the conveying device 10*c* to a conveying space outlet 44*c* of the conveying device 10*c* (FIG. 13). A conveying-space-free region exists between the conveying space outlet 44*c* and the conveying space inlet 42*c* as viewed along the circumferential direction. The circumferential direction runs at least substantially parallel to a conveying direction 32*c* of the conveying device 10*c* in and/or through the conveying space 12*c*. With regard to further features and functions of the conveying device 10*c* illustrated in FIGS. 9 to 13, reference may be made to the conveying device 10*a* described in the description of FIGS. 1 to 6, wherein a conveying medium store unit of the conveying device 10*c* is not illustrated in FIGS. 9 to 13.

The drive unit 26*c* is implemented as a plate disk drive unit. At least one drive axis 28*c* of a drive element 30*c* of the drive unit 26*c* runs at least substantially transversely with respect to the conveying direction 32*c* of the conveying device 10*c*, in particular at least substantially transversely with respect to a conveying direction 32*c* in and/or through a conveying space 12*c* of the conveying device 10*c*. The drive element 30*c* is implemented as a cam (FIG. 11). The drive element 30*c* is arranged on a rotatably mounted plate element 66*c* of the drive unit 26*c*, and is in particular formed in one piece with the plate element 66*c*. The plate element 66*c* is arranged so as to be rotationally conjoint with a rotor shaft 52*c* of a motor unit 48*c* of the drive unit 26*c*. The rotor shaft 52*c* comprises a rotary entrainment region by means of which the plate element 66*c* is connectable rotationally conjointly to the rotor shaft 52*c* (FIG. 10). The rotary entrainment region is provided for a form-fitting and/or force-fitting connection between the rotor shaft 52*c* and the plate element 66*c*. The motor unit 48*c* is formed as an electric motor unit. It is however also conceivable for the motor unit 48*c* to be of some other design that appears expedient to a person skilled in the art, for example to be designed as a combustion engine unit, as a hybrid motor unit or the like. Altogether, the drive unit 26*c* has a plurality of drive elements 30*c*, in particular at least two drive elements 30*c*, which are arranged on the plate element 66*c*. With regard to further features and functions of the drive unit 26*c* illustrated in FIGS. 9 to 13, reference may be made to the drive unit 26*a* described in the description of FIGS. 1 to 6, in particular FIG. 6.

The invention claimed is:

1. A conveying device at least for conveying a fluid, comprising:

at least one conveying space;

at least one conveying space element that at least partly delimits the conveying space and that is rigid; and at least one elastically deformable conveying element that forms the conveying space together with the conveying space element, wherein at least the conveying space element and the elastically deformable conveying element together form an exchangeable unit, the elastically deformable conveying element is arranged on the conveying space element in an at least partly convexly curved fashion, the elastically deformable conveying element is spring-elastic, the elastically deformable conveying element automatically seeks to re-assume a basic shape following a deformation, the elastically deformable conveying element is connected to the conveying space element in a non-releasable manner, the conveying space element comprises a rigid wall that forms at least one concave recess for at least partly forming, and delimiting, the conveying space, the conveying space element includes an inner surface that delimits the concave recess, the elastically deformable conveying element is at least partly movable into the concave recess of the conveying space element for conveyance of the fluid, the elastically deformable conveying element comprises, in a load-free state of the elastically deformable conveying element, a conveying surface which, viewed in a cross section of the elastically deformable conveying element, has a maximum transverse extent that is equivalent to a maximum transverse extent of the rigid wall, viewed in a cross section of the conveying space element that extends transversely to a conveying direction of the fluid in the conveying space, the maximum transverse extent of the elastically deformable conveying element is formed by a length of an outline of the elastically deformable conveying element facing the conveying space element, and the maximum transverse extent of the rigid wall of the conveying space element is formed by a length of an outline of the rigid wall, the maximum transverse extent of the conveying surface of the elastically deformable conveying element runs transversely to the conveying direction of the fluid in the conveying space and in a plane extending perpendicular to the conveying direction, and the conveying surface is utilizable in a targeted fashion for a conveyance of the fluid in the conveying space and/or through the conveying space.

2. The conveying device according to claim 1, further comprising at least one conveying medium store unit for storage of the fluid, wherein the conveying medium store unit forms the exchangeable unit together with the conveying space element and the elastically deformable conveying element.

3. The conveying device according to claim 2, wherein the conveying medium store unit is connected to the conveying space element in a non-releasable manner.

4. The conveying device according to claim 1, wherein the elastically deformable conveying element is configured for sealing at least one edge region of the conveying space element, which delimits the conveying space.

5. A pump device with at least one conveying device according to claim 1, further comprising at least one drive unit for driving the conveying device, wherein the drive unit is a helical drive unit, wherein at least one drive axis of a drive element of the drive unit extends at least substantially parallel to a conveying direction of the conveying device, wherein the drive unit comprises at least one drive element for deforming the conveying device during conveyance of the fluid, wherein the drive element is implemented as a drive helix, which acts directly on the elastically deformable conveying element.

6. A pump device with at least one conveying device according to claim 1, and with at least one drive unit for driving the conveying device, wherein the drive unit is implemented as a paternoster drive unit comprising at least one force action element, which is drivable, for the purpose of an action of a drive force onto the elastically deformable conveying element, in a circulating fashion, wherein, for the action of a drive force onto the elastically deformable conveying element, the force action element extends at least substantially parallel to a circulation plane in which the force action element is drivable in a circulating operation, wherein the force action element of the drive unit, which is embodied as a paternoster drive unit, is arranged on a wrap-around element of the drive unit embodied as the paternoster drive unit.

7. The pump device according to claim 6, wherein at least one drive axis of a drive element of the drive unit extends at least substantially transversely to a conveying direction of the conveying device.

8. A conveying device at least for conveying a fluid, comprising:

at least one conveying space;

at least one conveying space element that at least partly delimits the conveying space and that is rigid; and at least one elastically deformable conveying element that forms the conveying space together with the conveying space element, wherein at least the conveying space element and the elastically deformable conveying element together form an exchangeable unit, the elastically deformable conveying element is arranged on the conveying space element in an at least partly convexly curved fashion, the elastically deformable conveying element is spring-elastic, the elastically deformable conveying element automatically seeks to re-assume a basic shape following a deformation, the elastically deformable conveying element is connected to the conveying space element in a non-releasable manner, the conveying space element has, viewed in a cross section of the conveying space element that extends transversely to the conveying direction in the conveying space, at least two convex bulges and at least one concave recess arranged between the two convex bulges and into which the elastically deformable conveying element, for a conveyance of the fluid, is at least partly movable, a surface of the conveying space element, which is formed by the two convex bulges and the concave recess, forms a wall of the conveying space, the surface of the conveying space element delimits the conveying space, the elastically deformable conveying element comprises, in a load-free state of the elastically deformable conveying element, a conveying surface, and the conveying surface is utilizable in a targeted fashion for a conveyance of the fluid in the conveying space and/or through the conveying space.

9. A conveying device according to claim 8, wherein the elastically deformable conveying element comprises, in a load-free state of the elastically deformable conveying element, a conveying surface, which, viewed in a cross section of the elastically deformable conveying element that extends transversely to the conveying direction in the conveying space, has a maximum transverse extent that is equivalent to a maximum transverse extent of the wall of the conveying space element, the maximum transverse extent of the elastically deformable conveying element is formed by a length of an outline of the elastically deformable conveying element facing the conveying space element, the maximum transverse extent of the wall, viewed in a cross section of the conveying space element that extends transversely to the conveying direction in the conveying space, is formed by a length of an outline of the two convex bulges and the concave recess and the maximum transverse extent of the conveying surface of the elastically deformable conveying element runs transversely to a conveying direction in the conveying space and in a plane extending perpendicular to the conveying direction.

* * * * *